US009150975B2

(12) United States Patent
Berger et al.

(10) Patent No.: US 9,150,975 B2
(45) Date of Patent: Oct. 6, 2015

(54) ELECTROREFINER SYSTEM FOR RECOVERING PURIFIED METAL FROM IMPURE NUCLEAR FEED MATERIAL

(75) Inventors: John F. Berger, Wilmington, NC (US); Mark A. Williamson, Naperville, IL (US); Stanley G. Wiedmeyer, Glen Ellyn, IL (US); James L. Willit, Batavia, IL (US); Laurel A. Barnes, Chicago, IL (US); Robert J. Blaskovitz, Lockport, IL (US)

(73) Assignee: GE-HITACHI NUCLEAR ENERGY AMERICAS LLC, Wilmington, NC (US)

( * ) Notice: Subject to any disclaimer, the term of this patent is extended or adjusted under 35 U.S.C. 154(b) by 197 days.

(21) Appl. No.: 13/335,082

(22) Filed: Dec. 22, 2011

(65) Prior Publication Data

US 2013/0161186 A1 Jun. 27, 2013

(51) Int. Cl.

| | |
|---|---|
| ***C25C 3/34*** | (2006.01) |
| ***C25C 7/00*** | (2006.01) |
| ***C25C 7/08*** | (2006.01) |
| ***C25C 7/02*** | (2006.01) |

(52) U.S. Cl.

CPC ... *C25C 7/08* (2013.01); *C25C 3/34* (2013.01); *C25C 7/005* (2013.01); *C25C 7/025* (2013.01)

(58) Field of Classification Search

CPC ..... C25C 3/00; C25C 3/34; C25C 7/005; C25C 7/08; C25C 7/06; C25C 7/025

USPC ..... 204/247.2, 243.1, 245; 205/43–49

See application file for complete search history.

(56) References Cited

U.S. PATENT DOCUMENTS

| | | | |
|---|---|---|---|
| 422,139 | A | 2/1890 | Maxon |
| 658,891 | A | 10/1900 | Carmichael |
| 2,089,738 | A | 8/1935 | Elmer |

(Continued)

FOREIGN PATENT DOCUMENTS

| | | |
|---|---|---|
| AU | 622994 | 4/1992 |
| CA | 1 142 123 | 3/1983 |

(Continued)

OTHER PUBLICATIONS

International Search Report and Written Opinion issued in International Patent Application No. PCT/US2012/058663, issued Aug. 12, 2013.

International Search Report and Written Opinion issued in International Patent Application No. PCT/US2012/058531, issued Aug. 2, 2013.

European Search Report issued in European Patent Application No. 13163951.0, issued Aug. 29, 2013.

International search report issued in connection with WO Patent Application No. PCT/US2012/058659, Jul. 5, 2013.

(Continued)

*Primary Examiner* — Harry D Wilkins, III
*Assistant Examiner* — Ciel Thomas
(74) *Attorney, Agent, or Firm* — Harness, Dickey & Pierce, P.L.C.

(57) ABSTRACT

An electrorefiner system according to a non-limiting embodiment of the present invention may include a vessel configured to maintain a molten salt electrolyte and configured to receive a plurality of alternately arranged cathode and anode assemblies. The anode assemblies are configured to hold an impure nuclear feed material. Upon application of the power system, the impure nuclear feed material is anodically dissolved and a purified metal is deposited on the cathode rods of the cathode assemblies. A scraper is configured to dislodge the purified metal deposited on the cathode rods. A conveyor system is disposed at a bottom of the vessel and configured to remove the dislodged purified metal from the vessel.

18 Claims, 9 Drawing Sheets

(56) References Cited

U.S. PATENT DOCUMENTS

| | | | | |
|---|---|---|---|---|
| 2,194,444 | A | 3/1940 | Hulse et al. | |
| 2,766,198 | A | 10/1956 | Carosella | |
| 2,800,219 | A | 7/1957 | Carroll | |
| 2,913,380 | A | 11/1959 | Gullett | |
| 2,967,142 | A | 1/1961 | Oliver | |
| 3,562,131 | A | 2/1971 | Jasberg | |
| 3,645,708 | A * | 2/1972 | Grady | 65/19 |
| 3,697,404 | A | 10/1972 | Paige | |
| 3,972,794 | A | 8/1976 | Lamm | |
| 4,013,329 | A | 3/1977 | Hugin | |
| 4,023,673 | A | 5/1977 | Hansen | |
| 4,025,400 | A * | 5/1977 | Cook et al. | 205/74 |
| 4,039,403 | A | 8/1977 | Astley et al. | |
| 4,073,703 | A | 2/1978 | Kinosz | |
| 4,148,392 | A | 4/1979 | Larson et al. | |
| 4,203,531 | A | 5/1980 | Reichel et al. | |
| 4,326,937 | A | 4/1982 | Neumeier et al. | |
| 4,437,968 | A | 3/1984 | Elliott, Jr. | |
| 4,492,621 | A | 1/1985 | Stubb | |
| 4,608,135 | A | 8/1986 | Brown | |
| 4,668,353 | A | 5/1987 | Smith et al. | |
| 4,851,098 | A | 7/1989 | Kimura et al. | |
| 4,863,580 | A | 9/1989 | Epner | |
| 4,880,506 | A | 11/1989 | Ackerman et al. | |
| 4,946,026 | A | 8/1990 | Rickman | |
| 5,015,342 | A | 5/1991 | Ginatta et al. | |
| 5,415,742 | A | 5/1995 | La Camera et al. | |
| 5,454,914 | A | 10/1995 | Gay | |
| 5,531,868 | A | 7/1996 | Miller et al. | |
| 5,582,706 | A | 12/1996 | Grantham et al. | |
| 5,689,538 | A | 11/1997 | Bonhomme | |
| 5,770,034 | A | 6/1998 | Jansen et al. | |
| 5,855,749 | A | 1/1999 | Kohut et al. | |
| 5,935,394 | A | 8/1999 | Sivilotti et al. | |
| 6,142,291 | A | 11/2000 | Schulze et al. | |
| 6,540,902 | B1 | 4/2003 | Redey et al. | |
| 6,689,260 | B1 | 2/2004 | Ahluwalia et al. | |
| 6,821,405 | B1 | 11/2004 | Marttila | |
| 6,866,768 | B2 | 3/2005 | Bradford et al. | |
| 7,011,736 | B1 | 3/2006 | Miller et al. | |
| 7,090,760 | B2 | 8/2006 | Seo et al. | |
| 7,097,747 | B1 | 8/2006 | Herceg et al. | |
| 7,449,635 | B2 | 11/2008 | Wiant | |
| 7,563,982 | B2 | 7/2009 | Kimmel | |
| 7,638,026 | B1 | 12/2009 | Willit et al. | |
| 7,799,185 | B1 | 9/2010 | Willit | |
| 8,248,760 | B2 | 8/2012 | Abrahamsen et al. | |
| 2004/0007466 | A1 | 1/2004 | Seo et al. | |
| 2004/0011661 | A1 | 1/2004 | Bradford et al. | |
| 2004/0134785 | A1 | 7/2004 | Gay et al. | |
| 2004/0168932 | A1 | 9/2004 | Wang | |
| 2005/0067291 | A1 | 3/2005 | Haiki et al. | |
| 2005/0121319 | A1 | 6/2005 | Dufresne | |
| 2005/0205428 | A1 | 9/2005 | Dees et al. | |
| 2005/0233634 | A1 | 10/2005 | Kollmann | |
| 2006/0067291 | A1 | 3/2006 | Nakata | |
| 2006/0091017 | A1 * | 5/2006 | Lam | 205/102 |
| 2006/0096853 | A1 | 5/2006 | King | |
| 2007/0082551 | A1 | 4/2007 | Oesterhaus | |
| 2007/0295601 | A1 | 12/2007 | Bayer | |
| 2008/0128270 | A1 | 6/2008 | Hiraiwa et al. | |
| 2008/0142374 | A1 | 6/2008 | Iwama et al. | |
| 2008/0152270 | A1 | 6/2008 | Engesser et al. | |
| 2009/0050483 | A1 | 2/2009 | Li | |
| 2009/0152124 | A1 | 6/2009 | Ashford et al. | |
| 2010/0276259 | A1 | 11/2010 | Phalen | |
| 2011/0100328 | A1 | 5/2011 | Paul | |
| 2011/0180409 | A1 | 7/2011 | Willit et al. | |

FOREIGN PATENT DOCUMENTS

| | | | |
|---|---|---|---|
| CN | 1186528 | A | 7/1998 |
| CN | 1354808 | A | 6/2002 |
| DE | 26 00 344 | | 7/1977 |
| DE | 3837572 | | 5/1989 |
| DE | 19845258 | | 3/2000 |
| EP | 0 286 092 | A1 | 10/1988 |
| EP | 0 736 929 | | 10/1996 |
| EP | 2224542 | | 9/2010 |
| GB | 284678 | | 11/1928 |
| GB | 506590 | A | 5/1939 |
| GB | 516775 | | 1/1940 |
| JP | H05279887 | A | 10/1993 |
| JP | H0972991 | | 3/1997 |
| JP | 2006-308442 | | 11/2006 |
| JP | 3913725 | | 5/2007 |
| WO | WO 02/066709 | | 8/2002 |
| WO | WO 2004/018737 | | 3/2004 |
| WO | WO 2004/031453 | | 4/2004 |
| WO | WO 2005/035404 | | 4/2005 |
| WO | WO 2006/007863 | | 1/2006 |
| WO | WO 2009/062005 | | 5/2009 |
| WO | WO 2010/080761 | | 7/2010 |

OTHER PUBLICATIONS

"Electrolytic Reduction of Spent Oxide Fuel-Bench-Scale Test Results", Steven D. Herman, Shelly X. Li, Michael F. Simpson.

Jeong, et al., "Electrolytic production of metallic Uranium from U3O8 in a 20-kg batch scale reactor", Journal of Radioanalytical and Nuclear Chemistry, vol. 268, No. 2, pp. 349-356 (2006).

"Proceedings of GLOBAL 2005", Tsukuba, Japan, Oct 9-13, 2005, Paper No. 488.

International Search Report and Written Opinion issued in International Patent Application No. PCT/US2012/058664, mailed Jul. 8, 2013.

International Search Report and Written Opinion issued in International Patent Application No. PCT/US2012/058661, mailed Jul. 25, 2013.

Figueroa, J. et al., "GTRI Progress in Developing Pyrochemical Processes for Recovery of Fabrication Scrap and Reprocessing of Monolithic U-MO Fuel", RERTR 2011—International Meeting on Reduced Enrichment for Research and Test Reactors, Oct. 23, 2011, XP055071122.

International Search Report dated Jan. 20, 2012 issued in PCT/US2011/053589.

International Search Report dated Jan. 30, 2012 issued in PCT/US2011/053878.

International Search Report dated Feb. 6, 2012 issued in PCT/US2011/053872.

International Search Report dated May 11, 2012 issued in PCT/US2011/053871.

Journeau, et al., "Physico-chemical analyses and solidification path reconstruction of multi-component oxidic spread melts." Materials Science and Engineering A. vol. 299. Feb. 15, 2001. pp. 249-266.

International Atomic Energy Agency (IAEA). "Storage and Disposal of Spent Fuel and High Level Radioactive Waste". Additional paper to the IAEA's Nuclear Technology Review (2006), pp. 1-11.

Morss, et al., "Cerium, uranium, and plutonium behavior in glass-bonded sodalite, a ceramic nuclear waste form." Journal of Alloys and Compounds. vols. 303-304. May 24, 2000. pp. 42-48.

Abraham, et al., "Metal waste forms from treatment of EBR-II spent fuel." Argonne National Laboratory. Presented at Spectrum '98 Conference. Sep. 18, 1998, pp. 1-7.

International Panel on Fissile Materials (IPFM). "Spent Fuel from Nuclear Power Reactors: An Overview of a New Study by the International Panel on Fissile Materials" (Draft for Discussion). Jun. 2011, Edited by Harold Feiveson.

World Nuclear Association. "How uranium ore is made into nuclear fuel." Last accessed Oct. 10, 2014. <http://www.world-nuclear.org /Nuclear-Basics/How-is-uranium-ore-made-into-nuclear-fuel-/>.

Chinese Office Action issued in Chinese Application No. 201180061803.2, dated Jan. 5, 2015.

Chinese Office Action issued in corresponding Chinese Application No. 201180061829.7, dated Jan. 6, 2015.

* cited by examiner

ELECTROREFINER SYSTEM FOR RECOVERING PURIFIED METAL FROM IMPURE NUCLEAR FEED MATERIAL

FEDERALLY SPONSORED RESEARCH OR DEVELOPMENT

The present invention was made with Government support under contract number DE-AC02-06CH11357, which was awarded by the U.S. Department of Energy.

BACKGROUND

1. Field

The present invention relates to an electrolytic system configured to recover a metal from an impure feed material.

2. Description of Related Art

An electrochemical process may be used to recover metals from an impure feed and/or to extract metals from a metal-oxide. A conventional process (for soluble metal oxides) typically involves dissolving a metal-oxide in an electrolyte followed by electrolytic decomposition or (for insoluble metal oxides) selective electrotransport to reduce the metal-oxide to its corresponding metal. Conventional electrochemical processes for reducing insoluble metal-oxides to their corresponding metallic state may employ a single step or multiple-step approach.

A multiple-step approach may be a two-step process that utilizes two separate vessels. For example, the extraction of uranium from the uranium oxide of spent nuclear fuels includes an initial step of reducing the uranium oxide with lithium dissolved in a molten LiCl electrolyte so as to produce uranium metal and $Li_2O$ in a first vessel, wherein the $Li_2O$ remains dissolved in the molten LiCl electrolyte. The process then involves a subsequent step of electrowinning in a second vessel, wherein the dissolved $Li_2O$ in the molten LiCl is electrolytically decomposed to form oxygen and regenerate lithium. Consequently, the resulting uranium metal may be extracted in an electrorefining process, while the molten LiCl with the regenerated lithium may be recycled for use in the reduction step of another batch.

However, a multi-step approach involves a number of engineering complexities, such as issues pertaining to the transfer of molten salt and reductant at high temperatures from one vessel to another. Furthermore, the reduction of oxides in molten salts may be thermodynamically constrained depending on the electrolyte-reductant system. In particular, this thermodynamic constraint will limit the amount of oxides that can be reduced in a given batch. As a result, more frequent transfers of molten electrolyte and reductant will be needed to meet production requirements.

On the other hand, a single-step approach generally involves immersing a metal oxide in a compatible molten electrolyte together with a cathode and anode. By charging the anode and cathode, the metal oxide (which is in electrical contact with the cathode) can be reduced to its corresponding metal through electrolytic conversion and ion exchange through the molten electrolyte. However, although a conventional single-step approach may be less complex than a multi-step approach, the yield of the metallic product is relatively low. Furthermore, the metallic product still contains unwanted impurities.

SUMMARY

An electrorefiner system according to a non-limiting embodiment of the present invention may include a vessel, a plurality of cathode assemblies, a plurality of anode assemblies, a power system, a scraper, and/or a conveyor system. The vessel may be configured to maintain a molten salt electrolyte. The plurality of cathode assemblies may be configured to extend into the vessel so as to at least be partially submerged in the molten salt electrolyte. Each cathode assembly may include a plurality of cathode rods having the same orientation and arranged so as to be within the same plane. The plurality of anode assemblies may be alternately arranged with the plurality of cathode assemblies such that each anode assembly is flanked by two cathode assemblies. Each anode assembly may be configured to hold and immerse an impure metallic uranium feed material in the molten salt electrolyte. The power system may be connected to the plurality of cathode and anode assemblies. The power system may be configured to supply a voltage adequate to oxidize the impure uranium feed material to form uranium ions that migrate through the molten salt electrolyte and deposit on the plurality of cathode rods as purified uranium. A scraper may be configured to dislodge the purified uranium deposited on the plurality of cathode rods. The conveyor system may be disposed at a bottom of the vessel. The conveyor system may be configured to transport the purified uranium dislodged by the scraper through an exit pipe so as to remove the purified uranium from the vessel.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
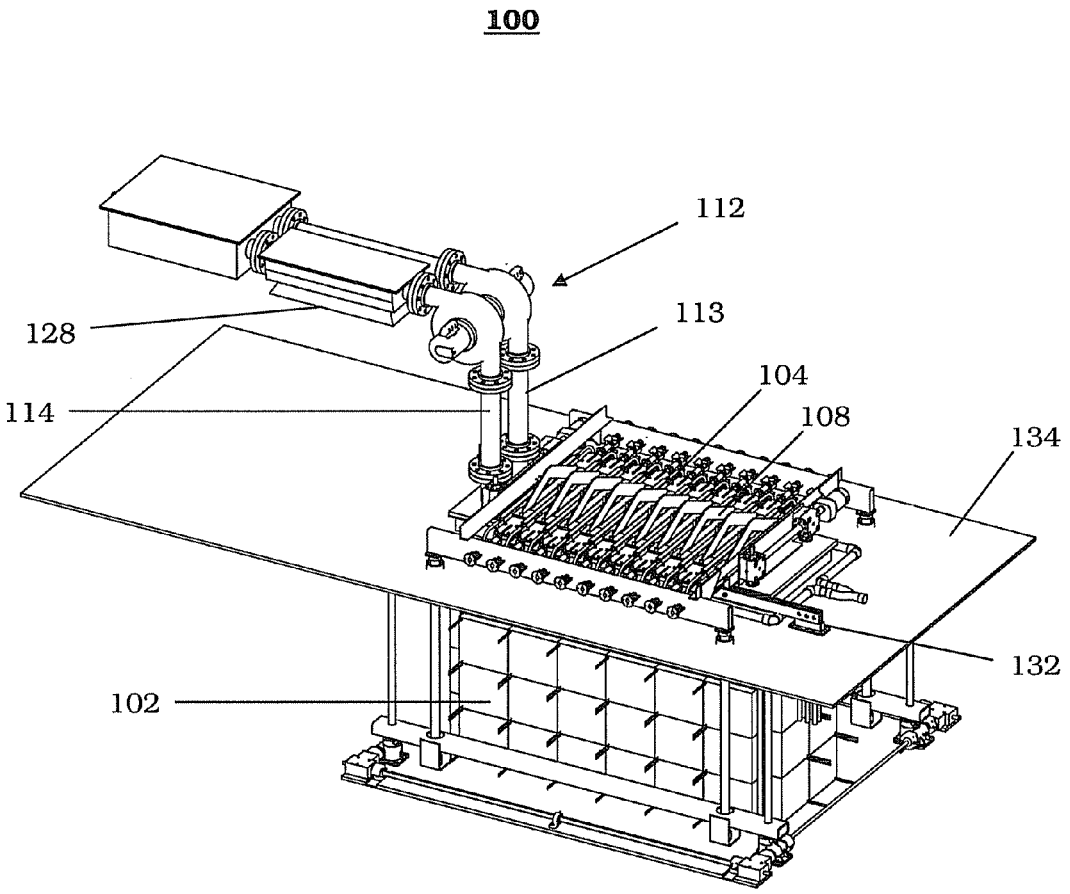
FIG. 1 is a perspective view of an electrorefiner system according to a non-limiting embodiment of the present invention.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations of one or more of the associated listed items.

It should be understood that, although the terms first, second, third, etc. may be used herein to describe various elements, components, regions, layers and/or sections, these elements, components, regions, layers, and/or sections should not be limited by these terms. These terms are only used to distinguish one element, component, region, layer, or section from another region, layer, or section. Thus, a first element, component, region, layer, or section discussed below could be termed a second element, component, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of example embodiments.

Unless otherwise defined, all ter (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

An electrorefiner system according to a non-limiting embodiment of the present invention may be used to recover a purified metal (e.g., uranium) from a relatively impure nuclear feed material (e.g., impure uranium feed material). The impure nuclear feed material may be a metallic product of an electrolytic oxide reduction system. The electrolytic oxide reduction system may be configured to facilitate the reduction of an oxide to its metallic form so as to permit the subsequent recovery of the metal. The electrolytic oxide reduction system may be as described in U.S. application Ser. No. 12/978,027, filed Dec. 23, 2010, "ELECTROLYTIC OXIDE REDUCTION SYSTEM," the entire contents of which is incorporated herein by reference.

Generally, the electrorefiner system may include a vessel, a plurality of cathode assemblies, a plurality of anode assemblies, a power system, a scraper, and/or a conveyor system. The power system may be as described in U.S. application Ser. No. 13/335,121, filed on even date herewith, titled "CATHODE POWER DISTRIBUTION SYSTEM AND METHOD OF USING THE SAME FOR POWER DISTRIBUTION," the entire contents of which are incorporated herein by reference. The scraper may be as described in U.S. application Ser. No. 13/335,209, filed on even date herewith, titled "CATHODE SCRAPER SYSTEM AND METHOD OF USING THE SAME FOR REMOVING URANIUM," the entire contents of which are incorporated herein by reference. The conveyor system may be as described in U.S. application Ser. No. 13/335,140, filed on even date herewith, titled "CONTINUOUS RECOVERY SYSTEM FOR ELECTROREFINER SYSTEM," the entire contents of which are incorporated herein by reference. However, it should be understood that the electrorefiner system is not limited thereto and may include other components that may not have been specifically identified herein. Furthermore, the electrorefiner system and/or electrolytic oxide reduction system may be used to perform a method for corium and used nuclear fuel stabilization processing. The method may be as described in U.S. application Ser. No. 13/453,290, filed on Apr. 23, 2012, titled "METHOD FOR CORIUM AND USED NUCLEAR FUEL STABILIZATION PROCESSING," the entire contents of which are incorporated herein by reference. A table of the incorporated applications being filed on even date herewith is provided below.

Related Applications Incorporated by Reference

| U.S. Appl. No. | HDP/GE Ref. | Filing Date | Title |
|---|---|---|---|
| 13/335,139 | 8564-000253/US 24AR252782 | Filed on even date herewith | BUS BAR ELECTRICAL FEEDTHROUGH FOR ELECTROREFINER SYSTEM |

-continued

| Related Applications Incorporated by Reference | | | |
|---|---|---|---|
| U.S. Appl. No. | HDP/GE Ref. | Filing Date | Title |
| 13/335,121 | 8564-000254/US 24AR252783 | Filed on even date herewith | CATHODE POWER DISTRIBUTION SYSTEM AND METHOD OF USING THE SAME FOR POWER DISTRIBUTION |
| 13/335,209 | 8564-000255/US 24AR252787 | Filed on even date herewith | CATHODE SCRAPER SYSTEM AND METHOD OF USING THE SAME FOR REMOVING URANIUM |
| 13/335,140 | 8564-000260/US 24AR256355 | Filed on even date herewith | CONTINUOUS RECOVERY SYSTEM FOR ELECTROREFINER SYSTEM |
| 13/453,290 | 8564-000262/US 24AR253193 | Filed on Apr. 23, 2012 | METHOD FOR CORIUM AND USED NUCLEAR FUEL STABILIZATION PROCESSING |

As noted above, the impure nuclear feed material for the electrorefiner system may be a metallic product of an electrolytic oxide reduction system. During the operation of an electrolytic oxide reduction system, a plurality of anode and cathode assemblies are immersed in a molten salt electrolyte. In a non-limiting embodiment of the electrolytic oxide reduction system, the molten salt electrolyte may be lithium chloride (LiCl). The molten salt electrolyte may be maintained at a temperature of about 650° C. (+50° C., −30° C.). An electrochemical process is carried out such that a reducing potential is generated at the cathode assemblies, which contain the oxide feed material (e.g., metal oxide). Under the influence of the reducing potential, the metal ion of the metal oxide is reduced and the oxygen (O) from the metal oxide (MO) feed material dissolves into the molten salt electrolyte as an oxide ion, thereby leaving the metal (M) behind in the cathode assemblies. The cathode reaction may be as follows:

$$MO+2e^{-}\rightarrow M+O^{2-}$$

At the anode assemblies, the oxide ion is converted to oxygen gas. The anode shroud of each of the anode assemblies may be used to dilute, cool, and remove the oxygen gas from the electrolytic oxide reduction system during the process. The anode reaction may be as follows:

$$O^{2-}\rightarrow \tfrac{1}{2}O_2+2e^{-}$$

The metal oxide may be uranium dioxide ($UO_2$), and the reduction product may be uranium metal. However, it should be understood that other types of oxides may also be reduced to their corresponding metals with the electrolytic oxide reduction system. Similarly, the molten salt electrolyte used in the electrolytic oxide reduction system is not particularly limited thereto and may vary depending of the oxide feed material to be reduced.

After the electrolytic oxide reduction, the basket containing the metallic product in the electrolytic oxide reduction system is transferred to the electrorefiner system according to the present invention for further processing to obtain a purified metal from the metallic product. Stated more clearly, the metallic product from the electrolytic oxide reduction system will serve as the impure nuclear feed material for the electrorefiner system according to the present invention. Notably, while the basket containing the metallic product is a cathode assembly in the electrolytic oxide reduction system, the basket containing the metallic product is an anode assembly in the electrorefiner system. Compared to prior art apparatuses, the electrorefiner system according to the present invention allows for a significantly greater yield of purified metal.

Figure 2:
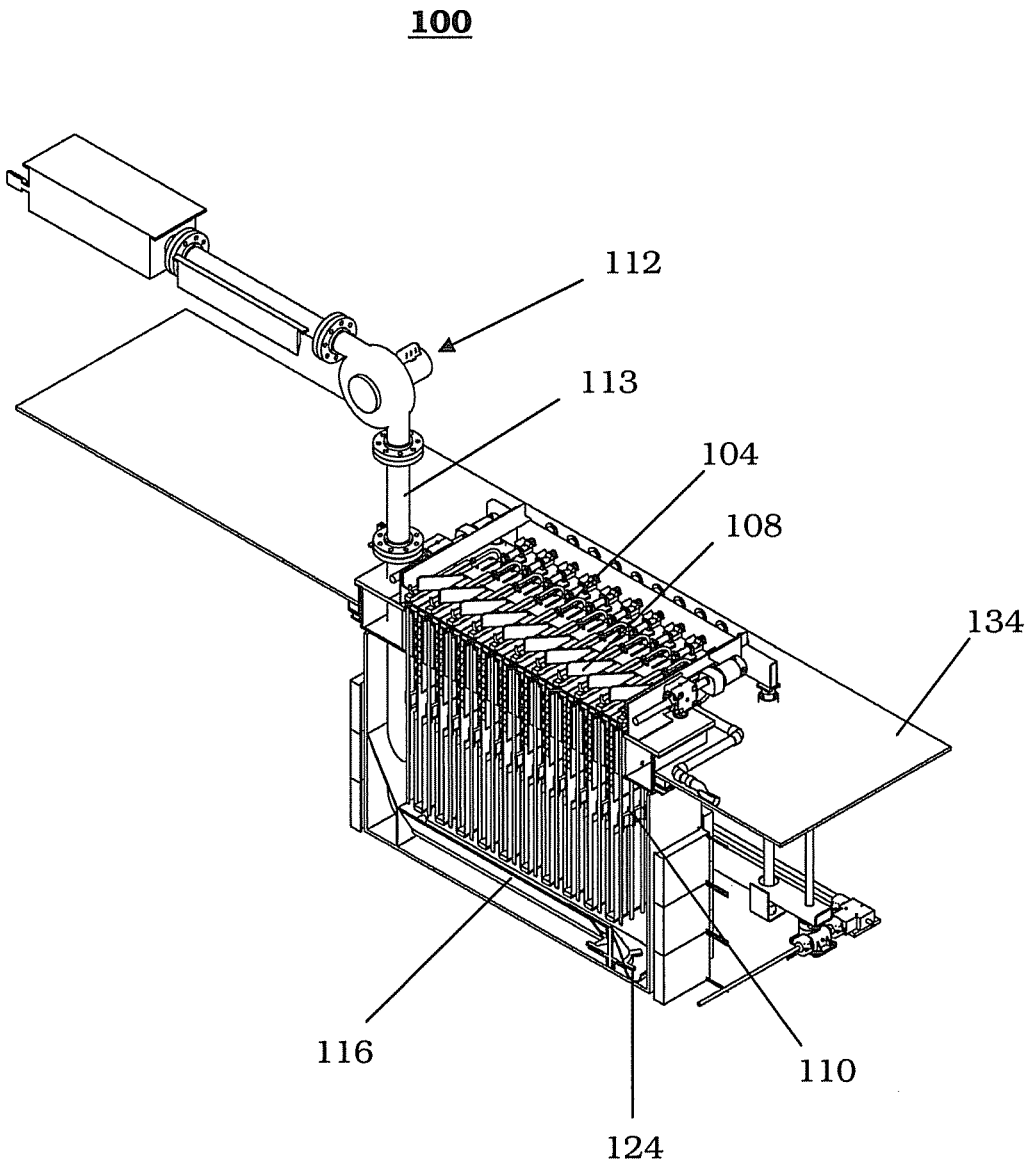
FIG. 2 is a perspective view of a cross-section of an electrorefiner system according to a non-limiting embodiment of the present invention.
Figure 3:
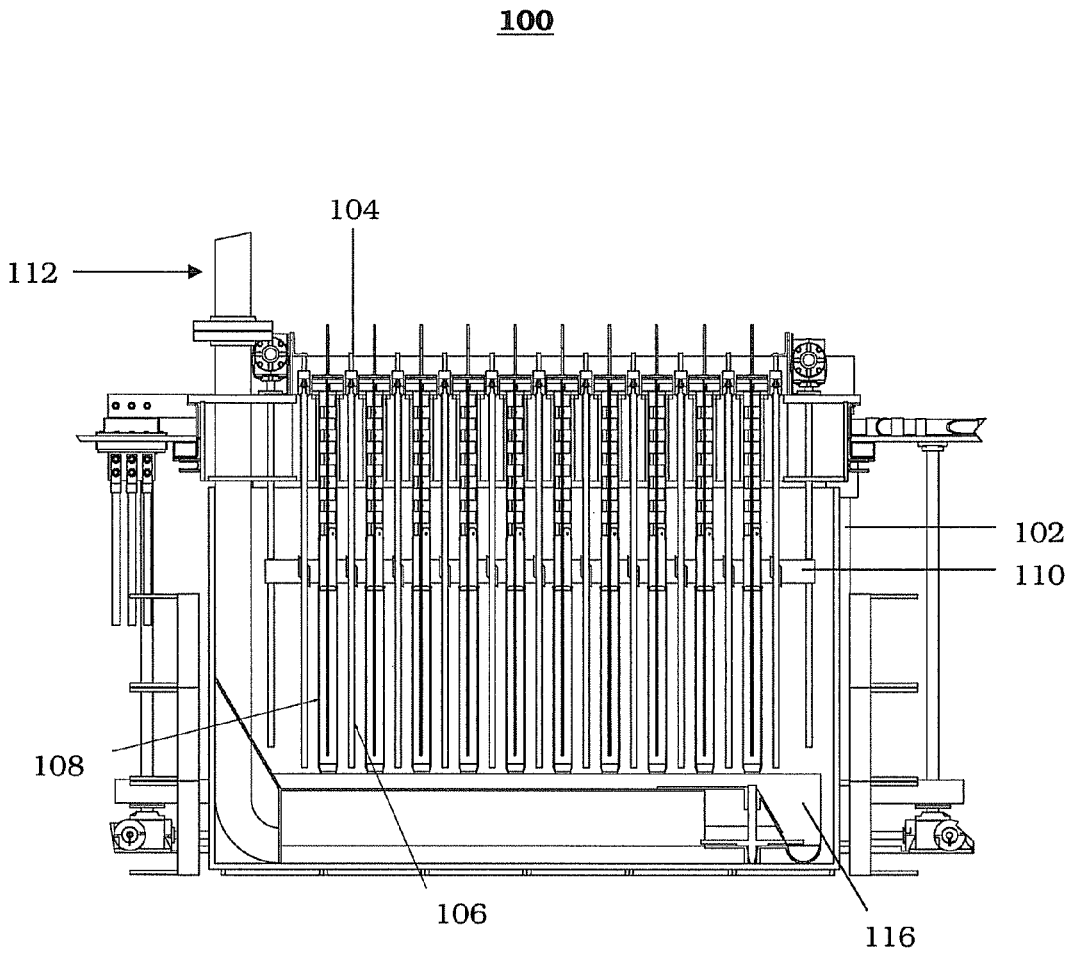
FIG. 3 is a cross-sectional side view of an electrorefiner system according to a non-limiting embodiment of the present invention.
Figure 4:
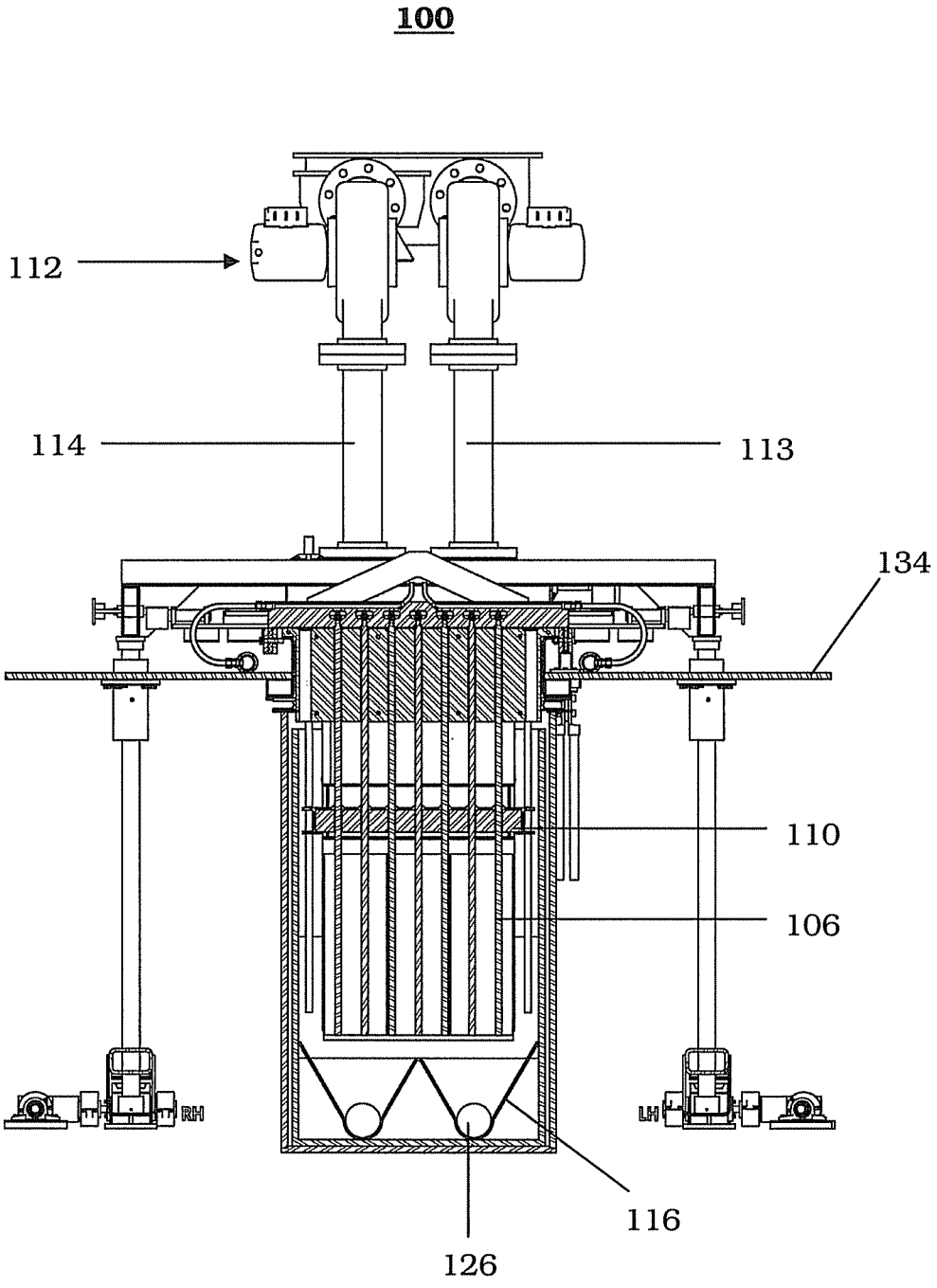
FIG. 4 is a cross-sectional end view of an electrorefiner system according to a non-limiting embodiment of the present invention.

FIG. 1 is a perspective view of an electrorefiner system according to a non-limiting embodiment of the present invention. FIG. 2 is a perspective view of a cross-section of an electrorefiner system according to a non-limiting embodiment of the present invention. FIG. 3 is a cross-sectional side view of an electrorefiner system according to a non-limiting embodiment of the present invention. FIG. 4 is a cross-sectional end view of an electrorefiner system according to a non-limiting embodiment of the present invention.

Referring to FIGS. 1-4, the electrorefiner system 100 includes a vessel 102, a plurality of cathode assemblies 104, a plurality of anode assemblies 108, a power system, a scraper 110, and/or a conveyor system 112. Each of the plurality of cathode assemblies 104 may include a plurality of cathode rods 106. The power system may include an electrical feedthrough 132 that extends through the floor structure 134. The floor structure 134 may be a glovebox floor of a glovebox. Alternatively, the floor structure 134 may be a support plate of a hot-cell facility. The conveyor system 112 may include an inlet pipe, a trough 116, a turn idler 124, a chain, a plurality of flights 126, an exit pipe 114, and/or a discharge chute 128. The conveyor system 112 will be described in further detail in connection with FIG. 5. The plurality of anode assemblies 108 will be described in further detail in connection with FIG. 6. The plurality of cathode assemblies 104 and the power system will be described in further detail in connection with FIG. 7. The scraper 110 will be described in further detail in connection with FIG. 8.

The vessel 102 is configured to maintain a molten salt electrolyte. In a non-limiting embodiment, the molten salt electrolyte may be LiCl, a LiCl—KCl eutectic, or another suitable medium. The vessel 102 may be situated such that a majority of the vessel 102 is below the floor structure 134. For instance, an upper portion of the vessel 102 may extend above the floor structure 134 through an opening in the floor structure 134. The opening in the floor structure 134 may correspond to the dimensions of the vessel 102. The vessel 102 is configured to receive the plurality of cathode assemblies 104 and the plurality of anode assemblies 108.

The plurality of cathode assemblies 104 are configured to extend into the vessel 102 so as to at least be partially submerged in the molten salt electrolyte. For instance, the dimensions of the plurality of cathode assemblies 104 and/or the vessel 102 may be adjusted such that the majority of the length of the plurality of cathode assemblies 104 is submerged in the molten salt electrolyte in the vessel 102. Each cathode assembly 104 may include a plurality of cathode rods 106 having the same orientation and arranged so as to be within the same plane.

The plurality of anode assemblies 108 may be alternately arranged with the plurality of cathode assemblies 104 such that each anode assembly 108 is flanked by two cathode assemblies 104. The plurality of cathode assemblies 104 and anode assemblies 108 may be arranged in parallel. Each anode assembly 108 may be configured to hold and immerse an impure uranium feed material in the molten salt electrolyte maintained by the vessel 102. The dimensions of the plurality of anode assemblies 108 and/or the vessel 102 may be adjusted such that the majority of the length of the plurality of anode assemblies 108 is submerged in the molten salt electrolyte in the vessel 102. Although the electrorefiner system 100 is illustrated in FIGS. 1-4 as having eleven cathode assemblies 104 and ten anode assemblies 108, it should be understood that the example embodiments herein are not limited thereto.

In the electrorefiner system 100, a power system is connected to the plurality of cathode assemblies 104 and anode assemblies 108. During operation of the electrorefiner system 100, the power system is configured to supply a voltage adequate to oxidize the impure uranium feed material in the plurality of anode assemblies 108 to form uranium ions that migrate through the molten salt electrolyte and deposit on the plurality of cathode rods 106 of the plurality of cathode assemblies 104 as purified uranium.

To initiate the removal of the purified uranium, the scraper 110 is configured to move up and down along the length of the plurality of cathode rods 106 to dislodge the purified uranium deposited on the plurality of cathode rods 106 of the plurality of cathode assemblies 104. As a result of the scraping, the dislodged purified uranium sinks through the molten salt electrolyte to the bottom of the vessel 102.

The conveyor system 112 is configured such that at least a portion of it is disposed at the bottom of the vessel 102. For example, the trough 116 of the conveyor system 112 may be disposed at the bottom of the vessel 102 such that the purified uranium dislodged from the plurality of cathode rods 106 accumulates in the trough 116. The conveyor system 112 is configured to transport the purified uranium accumulated in the trough 116 through an exit pipe 114 so as to remove the purified uranium from the vessel 102.

Figure 5:
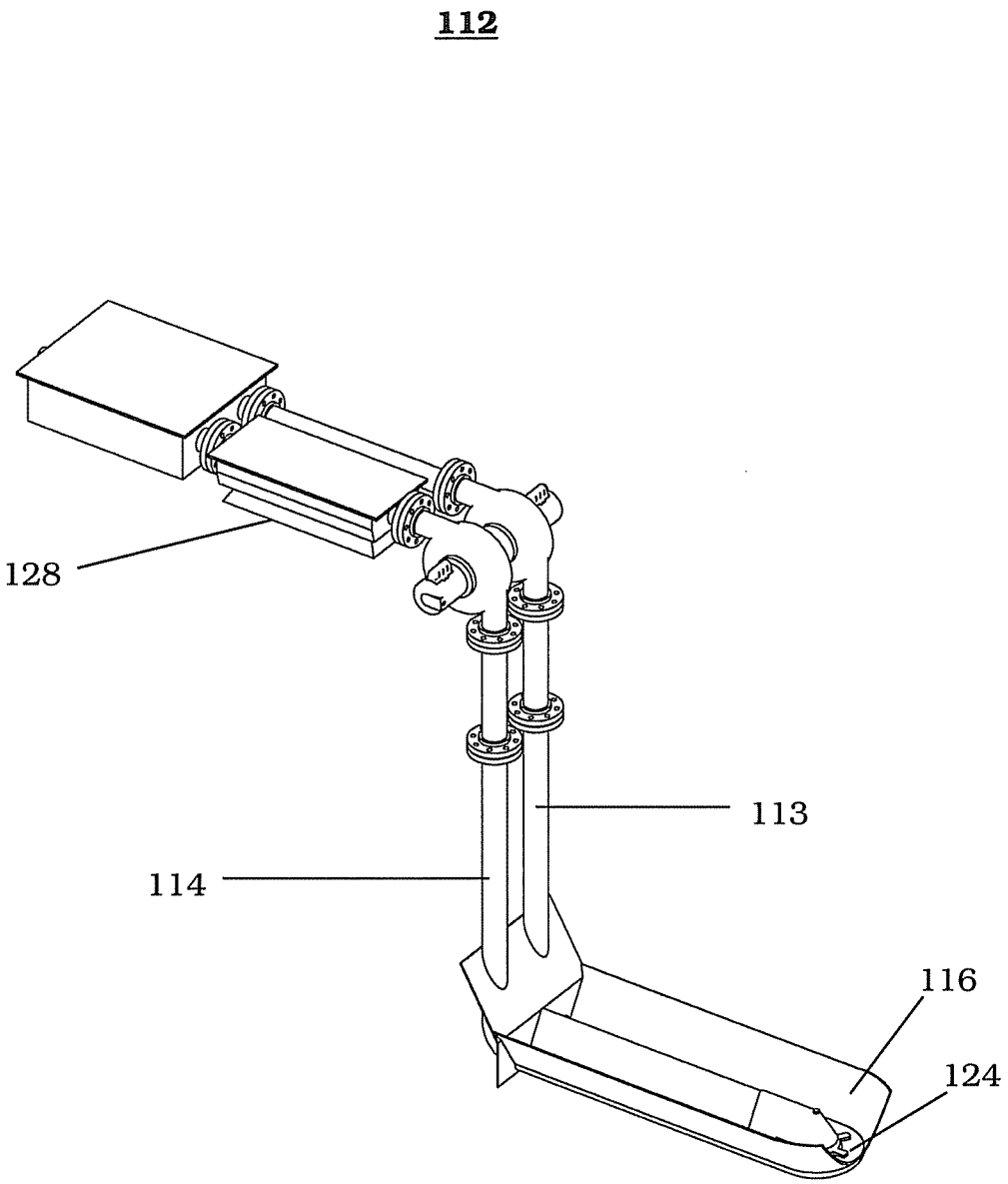
FIG. 5 is a perspective view of a conveyor system of an electrorefiner system according to a non-limiting embodiment of the present invention.

FIG. 5 is a perspective view of a conveyor system of an electrorefiner system according to a non-limiting embodiment of the present invention. Referring to FIG. 5, the conveyor system 112 may include an inlet pipe 113, a trough 116, a turn idler 124, a chain engaged with the turn idler 124, a plurality of flights 126 (FIG. 4), an exit pipe 114, and/or a discharge chute 128. The trough 116 is positioned in the vessel 102 so as to be below the plurality of cathode assemblies 104 and anode assemblies 108. The size of the trough 116 may be adjusted such that the trough 116 covers all or substantially all of the bottom surface of the vessel 102.

The trough 116 has a V-shaped cross-section, although example embodiments are not limited thereto. Alternatively, the trough 116 may have a U-shaped cross-section. In a non-limiting embodiment, the upper portion of the trough 116 may have a V-shaped cross-section, while the bottom portion of the trough 116 may have a U-shaped or semicircular cross-section. Additionally, the trough 116 may have a U-shaped track along the bottom of the vessel 102. For example, the track may extend linearly from the outlet opening of the inlet pipe, curve at a portion corresponding to the opposite end of the vessel 102, and extend linearly to the inlet opening of the exit pipe 114 so as to have a U-shape based on a plan view.

The conveyor system 112 may be configured to operate continuously during oxidation of the impure uranium feed material held by the plurality of anode assemblies 108, during deposition of the purified uranium on the plurality of cathode assemblies 104, and/or during dislodging of the purified uranium by the scraper 110. Alternatively, the conveyor system 112 may be configured to operate intermittently during the operation of the electrorefiner system 100. The conveyor system 112 includes a chain and a plurality of flights 126 secured to the chain. The chain is configured to run along the bottom of the vessel 102 and through the exit pipe 114. The chain and the plurality of flights 126 are configured to engage in an endless motion of entering, exiting, and reentering the vessel 102. For instance, the chain and the plurality of flights 126 may enter the vessel 102 through the inlet pipe 113, travel along the U-shaped track defined by the trough 116 at the bottom of the vessel 102, exit the vessel 102 through the exit pipe 114, and reenter the vessel 102 through the inlet pipe 113.

The plurality of flights 126 secured to the chain may be oriented in the same direction. For instance, the plurality of flights 126 may be oriented perpendicularly to the chain. During operation of the electrorefiner system 100, the plurality of flights 126 are configured to push the purified uranium dislodged by the scraper 110 into and through the exit pipe 114 to a discharge chute 128 so as to remove the purified uranium from the vessel 102.

Figure 6:
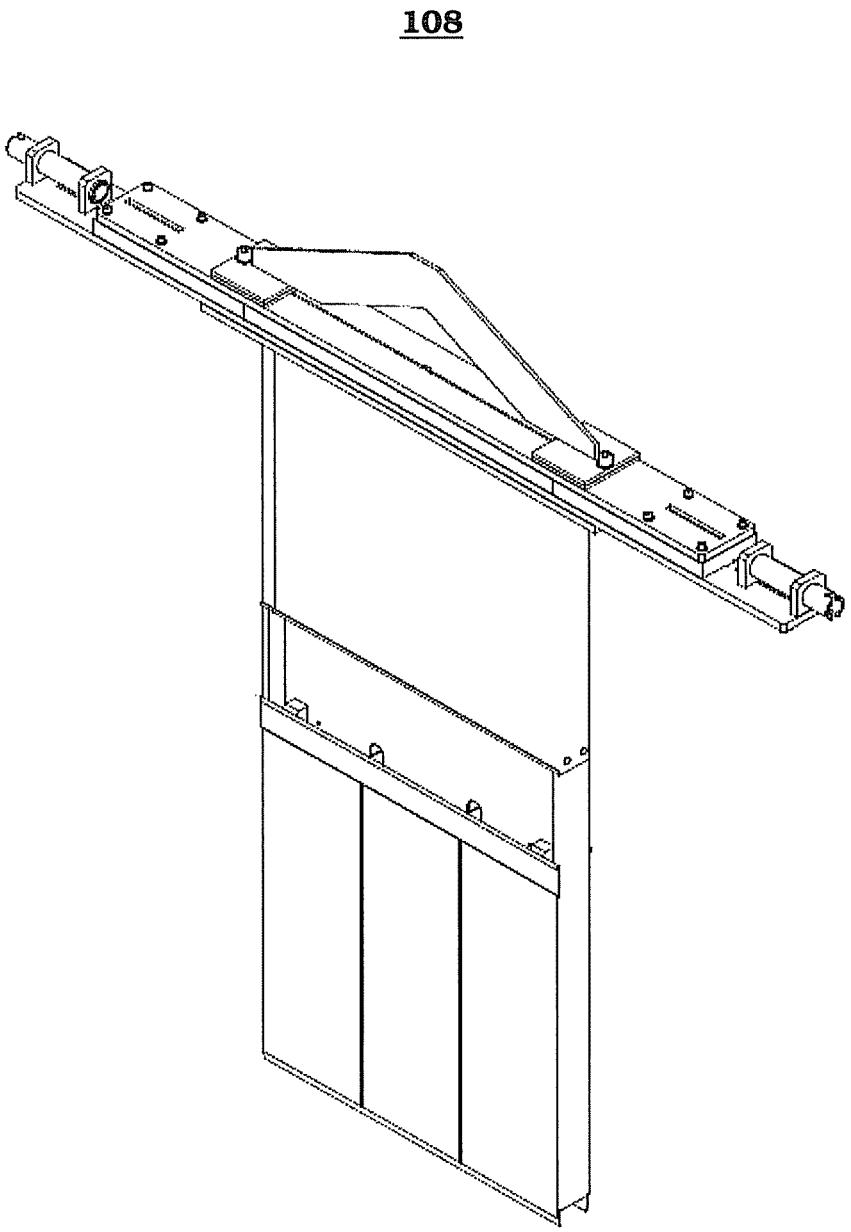
FIG. 6 is a perspective view of an anode assembly of an electrorefiner system according to a non-limiting embodiment of the present invention.

FIG. 6 is a perspective view of an anode assembly of an electrorefiner system according to a non-limiting embodiment of the present invention. Referring to FIG. 6, the anode assembly 108 is configured to hold and immerse an impure nuclear feed material in the molten salt electrolyte maintained by the vessel 102.

The anode assembly 108 may include an upper basket, a lower basket, and an anode plate housed within the upper and lower baskets. When assembled, the anode plate will extend from a top end of the upper basket to a bottom end of the lower basket. The side edges of the anode plate may be hemmed to provide rigidity. A reverse bend may also be provided down the center of the anode plate for added rigidity. The lower basket may be attached to the upper basket with four high strength rivets. In the event of damage to either the lower basket or the upper basket, the rivets can be drilled out, the damaged basket replaced, and re-riveted for continued operation.

The anode basket (which includes the upper basket and the lower basket) may be electrically connected to the anode plate. Each anode assembly 108 is configured to engage one or more pairs (e.g., two pairs) of knife edge contacts (e.g., four knife edge contacts) so as to receive power from a suitable power supply. For example, each anode assembly 108 may receive power from a dedicated power supply. Alternatively, all of the anode assemblies 108 may receive power from a single dedicated power supply. The anode basket may be formed of a porous metal plate that is sufficiently open to allow molten salt electrolyte to enter and exit during the process yet fine enough to retain the impure nuclear feed material.

Stiffening ribs may be provided inside the anode basket to reduce or prevent distortion. Where vertical stiffening ribs are provided in the lower basket, the anode plate will have corresponding slots to allow clearance around the stiffening ribs when the anode plate is inserted into the anode basket. For instance, if the lower basket is provided with two vertical stiffening ribs, then the anode plate will have two corresponding slots to allow clearance around the two stiffening ribs. Additionally, position spacers may be provided near the mid-section of both faces of the anode plate to ensure that the anode plate will remain in the center of the anode basket when loading the impure nuclear feed material. The position spacers may be ceramic and vertically-oriented. Furthermore, staggered spacers may be provided on the upper section of both faces of the anode plate to provide a thermal break for radiant and conductive heat transfer to the top of the anode assembly 108. The staggered spacers may be ceramic and horizontally-oriented. The anode assembly 108 may also include a lift bracket with lift tabs disposed on the ends. The lift tabs are designed to interface with a lift system 130 (FIG. 9) of the electrorefiner system 100.

Figure 7:
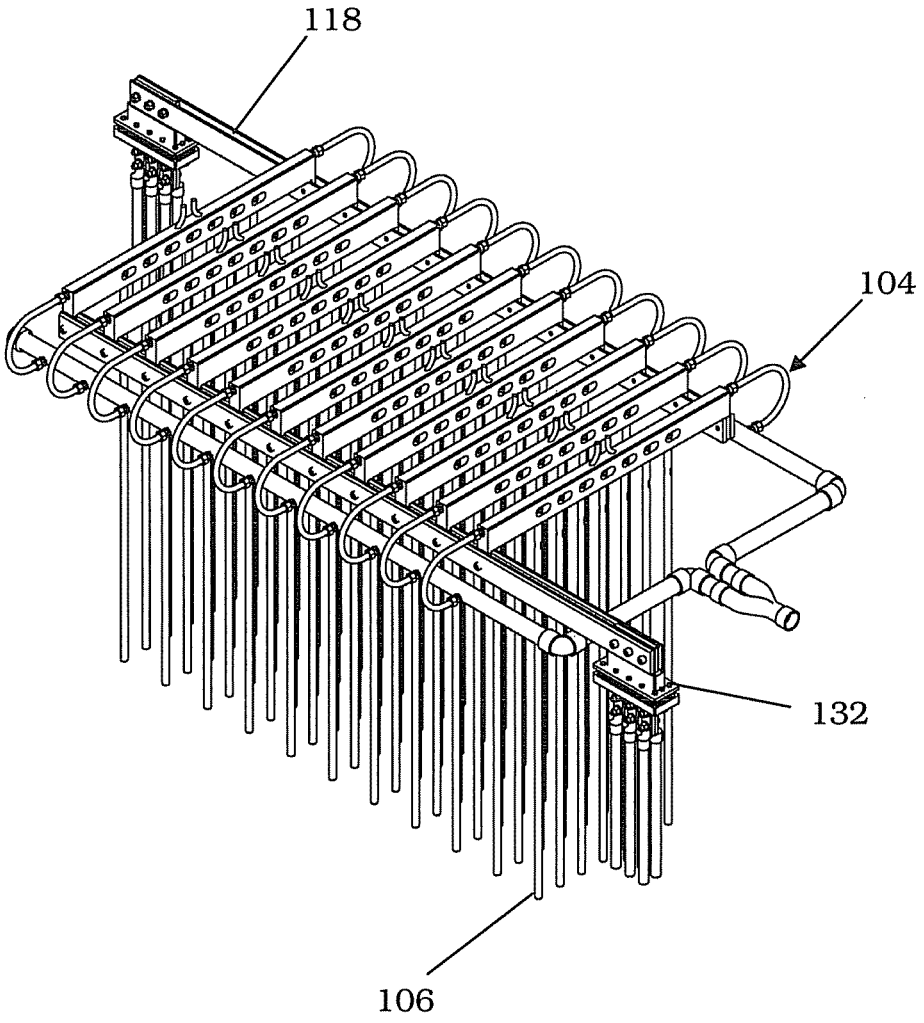
FIG. 7 is a perspective view of a plurality of cathode assemblies of an electrorefiner system according to a non-limiting embodiment of the present invention.

FIG. 7 is a perspective view of a plurality of cathode assemblies of an electrorefiner system according to a non-limiting embodiment of the present invention. Referring to FIG. 7, each of the plurality of cathode assemblies 104 includes a plurality of cathode rods 106 connected to a cathode bus bar. The plurality of cathode assemblies 104 are connected to a common bus bar 118. When positioned within the vessel 102 of the electrorefiner system 100, the cathode bus bars of the plurality of cathode assemblies 104 may be arranged parallel to each other and perpendicularly to the common bus bar 118. The common bus bar 118 is connected to an electrical feedthrough 132.

The upper and lower portions of each cathode rod 106 may be formed of different materials. For instance, the upper portion of the cathode rod 106 may be formed of a nickel alloy, and the lower portion of the cathode rod 106 may be formed of steel, although example embodiments are not limited thereto. The lower portion of the cathode rod 106 may sit below the molten salt electrolyte level during the operation of the electrorefiner system 100 and may be removable to allow the lower portion to be replaced or changed to another material.

The cathode bus bar may be segmented to reduce thermal expansion, wherein each segment of the cathode bus bar may be formed of copper. The segments of the cathode bus bar may be joined with a slip connector. Additionally, the slip connector may attach to the top of a cathode rod 106 to ensure that the cathode rod 106 will not fall into the molten salt electrolyte. The cathode assembly 104 is not to be limited by any of the above examples. Rather, it should be understood that other suitable configurations and materials may also be used.

When the cathode assembly 104 is lowered into the electrorefiner system 100, the cathode rods 106 will extend into the molten salt electrolyte in the vessel 102. Although the plurality of cathode assemblies 104 are shown as having seven cathode rods 106 each, it should be understood that the example embodiments are not limited thereto. Thus, each cathode assembly 104 may include less than seven cathode rods 106 or more than seven cathode rods 106, provided that sufficient current is being provided to the electrorefiner system 100.

During operation of the electrorefiner system 100, the cathode assembly 104 may be kept to a suitable temperature. To maintain the appropriate operating temperature, the cathode assembly 104 may include a cooling line that supplies a cooling gas. The cooling gas may be supplied to each side of the cathode assembly header and discharged into the glovebox, hot-cell facility, or other suitable environment where it is cooled and recycled. The cooling gas may be an inert gas (e.g., argon). As a result, the temperature of the off-gas may be lowered.

The cooling gas may be provided by the glovebox atmosphere. In a non-limiting embodiment, no pressurized, gases external to the glovebox are used. In such a case, a gas supply can be pressurized using a blower inside the glovebox. All motors and controls for operating the gas supply may be located outside the glovebox for easier access and maintenance.

The power system for the electrorefiner system 100 may include the common bus bar 118 for the plurality of cathode assemblies 104. As previously noted above, in addition to the disclosure herein, the power system may be as described in U.S. application Ser. No. 13/335,121, filed on even date herewith, titled "CATHODE POWER DISTRIBUTION SYSTEM AND METHOD OF USING THE SAME FOR POWER DISTRIBUTION," the entire contents of which are incorporated herein by reference. Power may be supplied to the common bus bar 118 through the floor structure 134 via the electrical feedthrough 132. As previously noted above, in addition to the disclosure herein, the electrical feedthrough 132 may be as described in U.S. application Ser. No. 13/335,139, filed on even date herewith, titled "BUS BAR ELECTRICAL FEEDTHROUGH FOR ELECTROREFINER SYSTEM," the entire contents of which are incorporated herein by reference.

Figure 8:
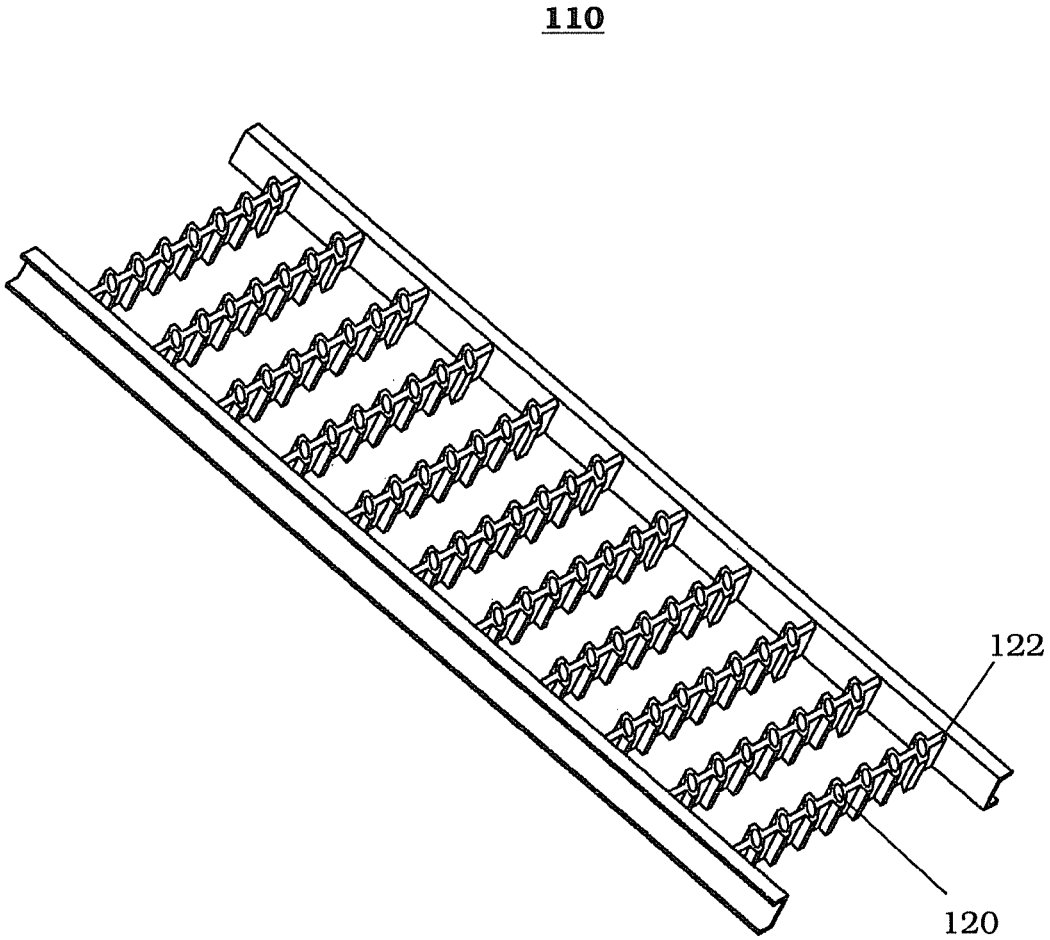
FIG. 8 is a perspective view of a scraper of an electrorefiner system according to a non-limiting embodiment of the present invention.

FIG. 8 is a perspective view of a scraper of an electrorefiner system according to a non-limiting embodiment of the present invention. Referring to FIG. 8, the scraper 110 is configured to mate with the plurality of cathode assemblies 104 when the scraper 110 is installed in the electrorefiner system 100. When installed, the plurality of cathode rods 106 of the plurality of cathode assemblies 104 extend through the scraper 110. The scraper 110 moves along a length of the plurality of cathode rods 106 to dislodge the purified uranium deposited thereon during the operation of the electrorefiner system 100.

The scraper 110 includes a plurality of scraping units 120. Each of the plurality of scraping units 120 are configured to mate with each of the plurality of cathode rods 106 of the plurality of cathode assemblies 104. For instance, each of the plurality of scraping units 120 has a hole configured to receive a corresponding cathode rod 106. The plurality of scraping units 120 corresponding to each cathode assembly 104 are connected to a common frame 122. Although the scraper 110 is illustrated as having eleven common frames 122, wherein each common frame 122 connects seven scraping units 120, the example embodiments are not limited thereto. It should be understood that the number of common frames 122 may be adjusted as needed to correspond to the number of cathode assemblies 104, and the number of scraping units 120 may be adjusted as needed to correspond to the number of cathode rods 106.

The electrorefiner system 100 may further include a screw mechanism configured to move the scraper 110 along the length of the plurality of cathode rods 106, although the example embodiments are not limited thereto. It should be understood that another suitable mechanism may be used to move the scraper 110 upwards and downwards along the length of the plurality of cathode rods 106. As previously noted above, in addition to the disclosure herein, the scraper 110 may be as described in U.S. application Ser. No. 13/335,209, filed on even date herewith, titled "CATHODE SCRAPER SYSTEM AND METHOD OF USING THE SAME FOR REMOVING URANIUM," the entire contents of which are incorporated herein by reference.

Figure 9:
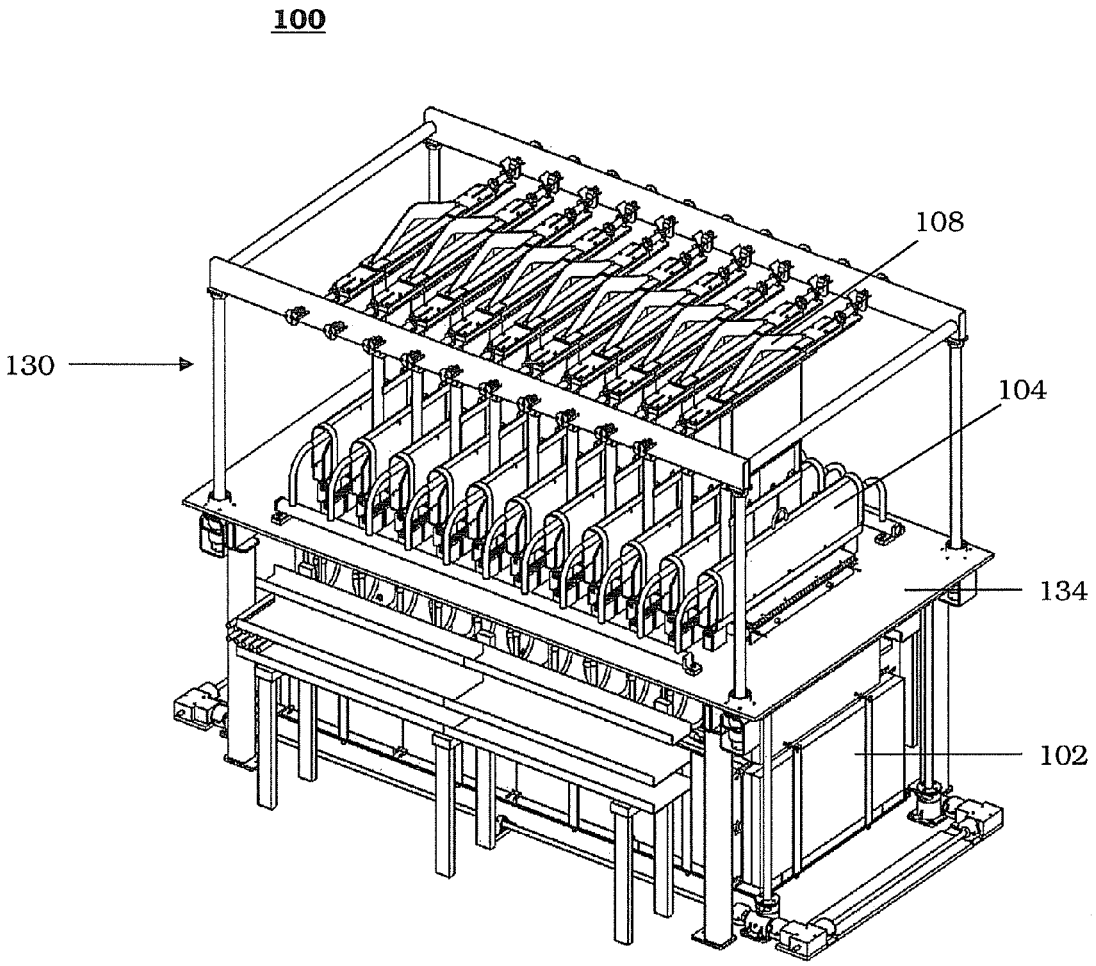
FIG. 9 is a perspective view of an electrorefiner system with a lift system that is in a raised position according to a non-limiting embodiment of the present invention.

FIG. 9 is a perspective view of an electrorefiner system with a lift system that is in a raised position according to a non-limiting embodiment of the present invention. Referring to FIG. 9, the electrorefiner system 100 may further include a lift system 130 configured to selectively engage any combination of the plurality of anode assemblies 108 so as to facilitate the simultaneous lifting of any combination of the plurality of anode assemblies 108 that are to be removed while allowing one or more of the plurality of anode assemblies 108 that are not to be removed to remain in place.

The lift system 130 may include a pair of lift beams arranged along a lengthwise direction of the electrorefiner system 100. The lift beams may be arranged in parallel. A shaft and a mechanical actuator are associated with each end portion of the lift beams. Although the lift system 130 is illustrated as engaging and lifting all of the plurality of anode assemblies 108, it should be understood that only some of the plurality of anode assemblies 108 may be lifted and any combination of the plurality of anode assemblies 108 may be allowed to remain in the vessel 102 of the electrorefiner system 100. Thus, all of the anode assemblies 108 may be simultaneously removed with the lift system 130 or only one anode assembly 108 may be removed. Additionally, although FIG. 9 illustrates the electrorefiner system 100 as having ten anode assemblies 108 and eleven cathode assemblies 104, it should be understood that the example embodiments are not limited thereto, because the modular design of the electrorefiner system 100 allows for more or less of the anode and cathode assemblies 108 and 104 to be used.

The two parallel lift beams of the lift system 130 extend along the alternating arrangement direction of the plurality of anode and cathode assemblies 108 and 104. The plurality of anode and cathode assemblies 108 and 104 are arranged between the two parallel lift beams. The two parallel lift beams may extend in a horizontal direction. The shaft of the lift system 130 is secured underneath both end portions of each lift beam. For example, the shaft may be secured perpendicularly to both end portions of each lift beam. The mechanical actuators of the lift system 130 are configured to drive the two parallel lift beams in a vertical direction via the shafts. A mechanical actuator is provided beneath each end portion of the two parallel lift beams.

The shaft may extend through the floor structure 134 by way of a hermetic slide bearing. The hermetic slide bearing may include two bearing sleeves and two gland seals. The bearing sleeves may be formed of high molecular weight polyethylene. A space between the two gland seals may be pressurized with an inert gas (e.g., argon) using a port to 1.5-3" water column positive pressure (assuming a maximum glovebox atmosphere of 1.5" water column negative). The gland seals are designed to be replaced without compromising the glovebox atmosphere. An external water-cooled flange may connect the vessel 102 to the floor structure 134 so as to maintain a hermetic seal while limiting a temperature of the floor structure 134 to an acceptable temperature.

The lift system 130 may include a plurality of lift cups dispersed along the longitudinal direction of each of the lift beams. Assuming the electrorefiner system 100 has ten anode assemblies 108 (although example embodiments are not limited thereto), ten lift cups may be disposed on each lift beam so as to provide two lift cups for each anode assembly 108. The lift cups are disposed on the inner side surface of the parallel lift beams. The lift cups may be U-shaped with the ends flaring outwards. However, it should be understood that the lift cups are not limited to such but, instead, are intended to include other shapes and forms (e.g., hook) that are suitable for engaging the lift pin of an anode assembly 108.

Each lift cup may be provided with a solenoid, although example embodiments are not limited thereto. Each solenoid may be mounted on the opposing outer side surface of the lift beam and is configured to drive (e.g., rotate) the corresponding lift cup. By providing each lift cup with a solenoid, each lift cup can be independently driven. However, it should be understood that the lift cups (which may be in different shapes and forms) may also be operated in different ways so as to engage the lift pin of an anode assembly 108. For example, instead of being rotated, the lift cup may be configured to extend to extend/retract so as to engage/disengage the lift pin of an anode assembly 108.

The lift cups may be arranged along each lift beam such that a pair of lift cups is associated with each of the plurality of anode assemblies 108. A "pair" refers to a lift cup from one lift beam and a corresponding lift cup from the other lift beam. The lift cups are spaced along each lift beam such that a pair of lift cups will be aligned with the lift tabs protruding from the side ends of each anode assembly 108 of the electrorefiner system 100. The lift cups may be vertically aligned with the corresponding lift tabs. Each pair of the lift cups is configured so as to be able to rotate and be positioned under the lift tabs protruding from side ends of a corresponding anode assembly 108. Otherwise, the lift cups may be rotated so as to be positioned above the lift tabs. When a pair of lift cups are positioned above the lift tabs of a corresponding anode assembly 108, lifting will not occur for that anode assembly 108 when the lift beams are raised.

The lift system 130 may be employed during the operation or maintenance of the electrorefiner system 100. For example, after the electrorefining process, the existing batch of anode assemblies 108 may be removed from the electrorefiner system 100 with the lift system 130 to allow a new batch of anode assemblies 108 to be processed. In the raised position, a portion of the anode assembly 108 may remain under the cover of the vessel 102 so as to act as a heat block until ready for removal.

During the electrorefining process, the lift cups may be inverted above the lift tabs of the anode assemblies 108. When one or more anode assemblies 108 are to be removed, the lift beams are lowered, and the lift cups on the lift beams are rotated by the solenoid so as to be positioned under the lift tabs of the anode assemblies 108 to be removed. Next, the mechanical actuators drive the shafts upward in a vertical direction, thereby raising the parallel lift beams along with the pertinent anode assemblies 108. While in the raised position, an electrical lock-out may keep the lift cups from actuating until the lift beams have been fully lowered. This feature will ensure that the anode assemblies 108 will not disengage while in the raised position. Once the existing batch of anode assemblies 108 has been retrieved and substituted with a new batch of anode assemblies 108 containing impure nuclear feed material, the anode assemblies 108 with the impure nuclear feed material may be lowered into the molten salt electrolyte in the vessel 102 of the electrorefiner system 100 via the lift system 130.

Alternatively, the anode assemblies 108 may be removed from the electrorefiner system 100 to allow for inspection, repairs, the replacement of parts, or to otherwise allow access to the portion of the vessel 102 that is normally occupied by the anode assemblies 108. The lift process may be as described above. Once the pertinent maintenance or other activity has been performed, the anode assemblies 108 may be lowered into the molten salt electrolyte in the vessel 102 of the electrorefiner system 100 via the lift system 130. Although FIG. 9 shows all of the anode assemblies 108 as being simultaneously removed when the lift system 130 is in the raised position, it should be understood that the lift system 130 is configured to allow the removal of anywhere from one to all of the anode assemblies 108, wherein the anode assemblies 108 may be adjacent or non-adjacent. Once the desired anode assemblies 108 are in the raised position, their removal from the lift system 130 may be achieved with another mechanism (e.g., crane) within the glovebox or hot-cell facility.

A method of electrorefining according to a non-limiting embodiment of the present invention may involve electrolytically processing a suitable feed material with the above-discussed electrorefiner system. As a result, the method may be used to recycle used nuclear fuel or recover a metal (e.g., uranium) from an off-specification metal oxide (e.g., uranium dioxide).

While a number of example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

The invention claimed is:

1. An electrorefiner system comprising:

a vessel with a bottom floor existing in a first plane, the vessel being configured to maintain a molten salt electrolyte;

a plurality of cathode assemblies configured to extend into the vessel so as to at least be partially submerged in the molten salt electrolyte, each cathode assembly including a plurality of cathode rods having a same orientation and arranged so as to be within a same second plane;

a plurality of anode assemblies alternately arranged with the plurality of cathode assemblies such that each anode assembly is flanked by two cathode assemblies, each anode assembly configured to hold and immerse an impure uranium feed material in the molten salt electrolyte;

a power system connected to the plurality of cathode and anode assemblies, the power system configured to supply a voltage adequate to oxidize the impure uranium feed material to form uranium ions that migrate through the molten salt electrolyte and deposit on the plurality of cathode rods as purified uranium;

a scraper configured to dislodge the purified uranium deposited on the plurality of cathode rods; and a conveyor system configured to remove from the vessel the purified uranium dislodged by the scraper, the conveyor system including an inlet pipe, a trough existing in a third plane that is about parallel to the first plane, an exit pipe, a discharge chute, and a chain with a plurality of flights secured thereto, the chain with the plurality of flights secured thereto configured to engage in an endless motion of entering the vessel through the inlet pipe, traveling along a U-shaped track defined by the trough, exiting the vessel through the exit pipe, and reentering the vessel through the inlet pipe in order to transport the purified uranium dislodged by the scraper through the exit pipe to the discharge chute, the U-shaped track being U-shaped as the track is viewed from a perspective that is about perpendicular to the third plane.

2. The electrorefiner system of claim 1, wherein the trough is disposed at a bottom of the vessel.

3. The electrorefiner system of claim 1, wherein the trough is positioned below the plurality of cathode and anode assemblies.

4. The electrorefiner system of claim 1, wherein the trough has a V-shaped cross-section.

5. The electrorefiner system of claim 1, wherein the U-shaped track extends from the inlet pipe to the exit pipe.

6. The electrorefiner system of claim 1, wherein the plurality of cathode and anode assemblies are arranged in parallel.

7. The electrorefiner system of claim 1, wherein the power system includes a common bus bar for the plurality of cathode assemblies.

8. The electrorefiner system of claim 1, wherein the scraper is configured to mate with the plurality of cathode assemblies such that the plurality of cathode rods extend through the scraper when the scraper moves along a length of the plurality of cathode rods.

9. The electrorefiner system of claim 8, wherein the scraper includes a plurality of scraping units, each of the plurality of scraping units is configured to mate with each of the plurality of cathode rods, and the plurality of scraping units corresponding to each cathode assembly are connected to a common frame.

10. The electrorefiner system of claim 8, further comprising:

a screw mechanism configured to move the scraper along the length of the plurality of cathode rods.

11. The electrorefiner system of claim 1, wherein the conveyor system is configured to operate continuously or intermittently during oxidation of the impure uranium feed material held by the plurality of anode assemblies, during deposition of the purified uranium on the plurality of cathode assemblies, and during dislodging of the purified uranium by the scraper.

12. The electrorefiner system of claim 1, wherein the chain and the plurality of flights secured thereto form a continuous loop through the inlet pipe, along the U-shaped track, and through the exit pipe.

13. The electrorefiner system of claim 1, wherein the plurality of flights are oriented in a same direction.

14. The electrorefiner system of claim 1, wherein the plurality of flights are oriented perpendicularly to the chain.

15. The electrorefiner system of claim 1, further comprising:

a lift system configured to selectively engage any combination of the plurality of anode assemblies so as to facilitate the simultaneous lifting of any combination of the plurality of anode assemblies that are to be removed while allowing one or more of the plurality of anode assemblies that are not to be removed to remain in place.

16. The electrorefiner system of claim 1, wherein the inlet pipe and the exit pipe extend upward from a same end of the trough.

17. The electrorefiner system of claim 1, wherein the U-shaped track extends linearly from an outlet opening of the inlet pipe, curves at a portion corresponding to an opposite end of the vessel from the inlet pipe, and extends linearly to an inlet opening of the exit pipe.

18. The electrorefiner system of claim 1, wherein the trough defines a U-shaped recess as the U-shaped track.

* * * * *